US010111495B2

(12) United States Patent
Polegato Moretti et al.

(10) Patent No.: US 10,111,495 B2
(45) Date of Patent: Oct. 30, 2018

(54) VENTILATED SHOE

(71) Applicant: GEOX S.P.A., Montebelluna (IT)

(72) Inventors: Mario Polegato Moretti, Crocetta del Montello (IT); Livio Poloni, Caerano di San Marco (IT)

(73) Assignee: GEOX S.p.A., Montebelluna (IT)

( * ) Notice: Subject to any disclaimer, the term of this patent is extended or adjusted under 35 U.S.C. 154(b) by 0 days.

(21) Appl. No.: 15/319,430

(22) PCT Filed: Jun. 17, 2015

(86) PCT No.: PCT/EP2015/063623
§ 371 (c)(1),
(2) Date: Dec. 16, 2016

(87) PCT Pub. No.: WO2015/193385
PCT Pub. Date: Dec. 23, 2015

(65) Prior Publication Data

US 2017/0150783 A1 Jun. 1, 2017

(30) Foreign Application Priority Data

Jun. 17, 2014 (IT) ..... PD2014A0148

(51) Int. Cl.
*A43B 23/02* (2006.01)
*A43B 7/08* (2006.01)
*A43B 13/38* (2006.01)

(52) U.S. Cl.
CPC ..... *A43B 23/022* (2013.01); *A43B 7/082* (2013.01); *A43B 7/085* (2013.01); *A43B 7/087* (2013.01); *A43B 13/386* (2013.01); *A43B 23/026* (2013.01)

(58) Field of Classification Search
CPC ..... A43B 7/082; A43B 7/085; A43B 7/087
(Continued)

(56) References Cited

U.S. PATENT DOCUMENTS 2,099,436 A * 11/1937 Donovan ..... A43B 7/1495 36/170
4,073,072 A 2/1978 Gross et al.
(Continued)

FOREIGN PATENT DOCUMENTS

CN 2274899 Y 2/1998
CN 2770417 Y 4/2006
(Continued)

OTHER PUBLICATIONS

International Search Report dated Jul. 22, 2015 in PCT/EP2015/063623 filed Jun. 1, 2015.
(Continued)

*Primary Examiner* — Ted Kavanaugh
(74) *Attorney, Agent, or Firm* — Oblon, McClelland, Maier & Neustadt, L.L.P.

(57) ABSTRACT

A ventilated shoe, including a sole and an upper assembly associated therewith in an upward region, the upper assembly including: an external upper, with which an inner lining is associated which is constituted at least partly by a first element that defines at least one interspace that separates the foot of the user from the external upper and includes preferential passages for sweat that moves away from the foot of the user toward the upper external edge of the shoe; and a breathable insole, joined perimetrically at least to the inner lining.

18 Claims, 3 Drawing Sheets

(58) Field of Classification Search
USPC ..... 36/3 A, 3 B, 3 R
See application file for complete search history.

(56) References Cited

U.S. PATENT DOCUMENTS

| | | | | |
|---|---|---|---|---|
| 5,295,312 | A | 3/1994 | Blumberg et al. | |
| 5,746,013 | A | 5/1998 | Fay, Sr. | |
| 2009/0104404 | A1 | 4/2009 | Polegato Moretti | |
| 2012/0151805 | A1* | 6/2012 | Polegato Moretti ..... | A43B 7/06 36/25 R |

FOREIGN PATENT DOCUMENTS

| | | | |
|---|---|---|---|
| CN | 102113732 | A | 7/2011 |
| CN | 102573550 | B | 8/2015 |
| EP | 1 723 863 | A1 | 11/2006 |
| KR | 10-1347130 | B1 | 1/2014 |
| WO | 2007/107264 | A1 | 9/2007 |
| WO | WO 2011/023509 | A1 | 3/2011 |
| WO | WO 2016/005570 | A1 | 1/2016 |

OTHER PUBLICATIONS

Italian Search Report dated Feb. 12, 2015 in Italian Application PD20140148 filed Jun. 17, 2014.
Office Action dated Feb. 27, 2018 in corresponding Chinese Application No. 201580032514.8 with English Translation.
Search Report completed Mar. 20, 2018 in corresponding Georgian Application No. AP 2015 014375 with English Translation.

* cited by examiner

VENTILATED SHOE

The present invention relates to a ventilated shoe.

It is known that a shoe, in order to be comfortable, in addition to anatomically fitting properties must ensure a correct exchange of heat and water vapor between the microclimate inside the shoe and the external microclimate, which coincides with the ability to dissipate outwardly the water vapor that forms due to the sweating of the foot.

The part of the foot that usually is most subject to sweating is the sole. Sweat saturates the internal environment of the shoe and mostly condenses, stagnating on the insole, but not only.

Shoes are known which solve the problem of internal vapor perspiration by using a sole made of perforated elastomer, on which a membrane that is permeable to water vapor and impermeable to water is sealed, so as to cover its through openings in order to ensure breathability and at the same time waterproofness.

However, in order to ensure good heat exchange between the internal microclimate and the external one, permeability to water vapor must be ensured not only at the sole but substantially over the entire shoe.

In the presence of overheating, in an attempt to return to an optimum situation, the body in fact reacts with a self-regulation mechanism, and therefore a cooling mechanism, by increasing perspiration, which, by evaporating, allows a natural reduction of body temperature. This mechanism occurs in general for the entire body.

The heat warms the air contained between the body and the clothes or shoes. Shoes are very often shaped so as to wrap around the foot and therefore the heated air, which as such would tend to rise, causes a further overheating in the regions in close contact with the upper.

If the water vapor is unable to escape from the upper, it remains trapped between the foot and the regions of the upper that do not adhere directly thereto and moisture increases until the vapor condenses and returns to the liquid state of sweat inside the shoe.

Shoes of this type, though being provided with a breathable sole, are unable to ensure an adequate level of comfort due to insufficient perspiration of the water vapor toward the outside through the surface of the upper and also because they are not studied to eliminate any sweat that has condensed and has become a liquid.

Shoes should therefore be capable of allowing the foot its normal perspiration, ensuring the escape of the water vapor, produced by sweating, around the entire foot, not only at the sole of the foot and the sole of the shoe, by means of good ventilation.

In an attempt to perform this function, a type of shoe has been proposed in the past, in U.S. Pat. No. 5,746,013, which has an upper joined to the outer sole and is provided with a breathable lining that comprises an outer layer made of hydrophilic material and an inner layer made of hydrophobic material, which are separated by monofilament yarns of hydrophobic material that are interwoven with the two layers, so as to define an air chamber between them.

The use of such a lining facilitates the transverse transfer of the water vapor and heat from the inner layer through the air chamber to the outer layer, which absorbs moisture and transfers it to the external upper, from which it evaporates into the external environment. The transfer occurs by utilizing the differentiation of the layers that compose it, which is determined by the hydrophilicity and hydrophobicity of their materials.

This transfer does not appear to be sufficient to ensure correct dissipation of sweat and correct ventilation around the entire foot.

Another solution has been described in patent JP19930089939, according to which the shoe is provided with a lining and with an insole made of three-dimensional fabric. In this case, when the shoe touches the ground, the cavity of the three-dimensional fabric of the insole is compressed by the weight of the foot, causing perspiration through openings at the peripheral region of the insole. Vice versa, when the foot is raised from the ground, air is absorbed from outside.

However, lateral ventilation, proximate to the insole, is unable to dissipate the vapor that surrounds the foot and which, being prevented from rising, creates moisture around the foot proper.

The aim of the invention is to provide a shoe that is capable of ensuring better dissipation of sweat both in the vapor phase and in the liquid phase with respect to the above cited breathable shoes.

Within this aim, an object of the present invention is to provide a shoe that is capable of ensuring ventilation around the foot of the user for correct exchange of heat and water vapor between the internal microclimate and the external one, even if the outer material of the upper is not breathable.

Another object of the present invention is to provide a shoe that is physiologically more comfortable and which, by allowing natural temperature regulation of the foot of the user, allows to keep the foot dry longer.

This aim, as well as these and other objects that will become better apparent hereinafter, are achieved by a ventilated shoe, comprising a sole and an upper assembly associated therewith in an upward region, said shoe being characterized in that said upper assembly comprises:

- an external upper, with which an inner lining is associated which is constituted at least partly by a first element that defines at least one interspace that separates the foot of the user from said external upper and is provided with preferential passages for the sweat that moves away from the foot of the user toward the upper outer edge of said shoe,
- a breathable insole, joined perimetrically at least to said inner lining.

Further characteristics and advantages of the invention will become better apparent from the description of a preferred but not exclusive embodiment of the shoe according to the invention, illustrated by way of a nonlimiting example in the accompanying drawings, wherein.

Figure 1:
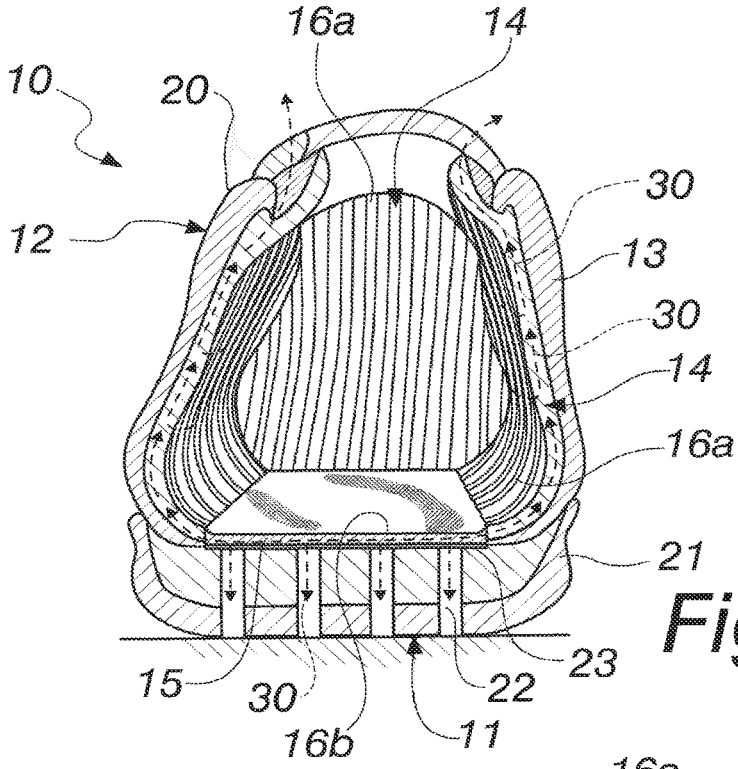
FIG. 1 is a transverse sectional view of a portion of a shoe according to the invention.

With reference to the figures, the shoe according to the invention is designated generally by the reference numeral 10.

The shoe 10 is ventilated, since it comprises a sole 11 and, associated therewith, an upper assembly 12, which in turn comprises an external upper 13, with an inner lining 14, and a breathable insole 15 that is joined perimetrically to the inner lining 14 and to the external upper 13, preferably by stitching.

The inner lining 14 is constituted at least partially by a first element 16*a*, which defines an interspace 17*a* that separates the foot of the user from the external upper 13 and is provided with preferential passages (described in greater detail hereinafter) for the sweat that moves away from the foot of the user toward the external edge 20 of the shoe 10.

The first element 16*a* is constituted by a first fabric, which is advantageously three-dimensional.

The expression "three-dimensional fabric" is understood commonly to reference a single fabric the component fibers of which are arranged in a mutually perpendicular planar relation. From the point of view of the production process, in a weaving of the 3-D type, the sets of fibers X and Y are woven with the rows and columns of the axial fibers Z. The expression "sets of fibers X and Y" is understood to reference respectively the horizontal and vertical weft sets. The expression "fibers Z" is understood to reference the set of multilayer warp. It is possible to obtain three-dimensional fabrics also with weaving processes of the 2-D type.

Three-dimensional fabrics usually are formed by multiple layers, with a variable distance between the fibers, and have excellent kinetic energy absorption, resiliency and shape recovery properties. Furthermore, they allow excellent flow of air both transversely and longitudinally inside their structure.

FIG. 1 clearly shows the insole 15 of the shoe 10 and the overlap of the inner lining 14 with the external upper 13. The illustrated example refers to a cross-section of a shoe provided with a process of the so-called Strobel type, but the same described shoe structure can also be provided by means of other processes, such as the tubular process, the process known as "AGO-lasting" or the process with lower central stitched seam.

Figure 3:
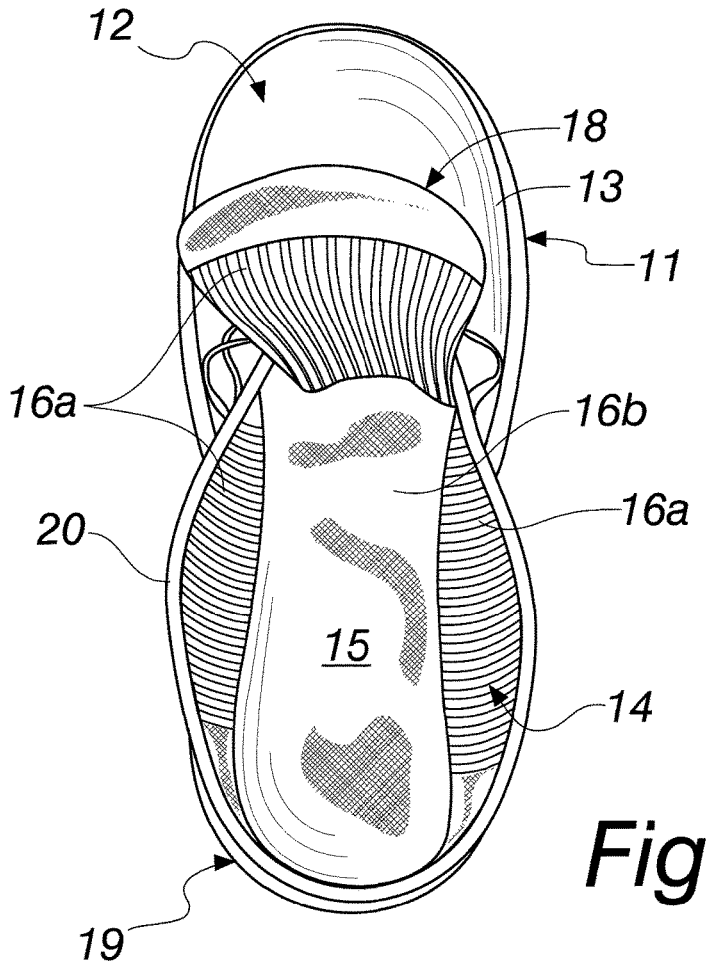
FIG. 3 is a top plan view of a shoe according to the invention.

FIG. 3 illustrates the shoe 10 in a top plan view, with the tongue 18 directed outwardly in order to allow to view the inside of the shoe 10. In this figure it is possible to notice which parts of the inner lining 14 are constituted by the first element 16*a* and therefore by the first fabric. These parts do not cover the last portion of the tongue 18 and the upper external edge 20 of the shoe 10 and in this case also do not cover the rear region 19.

The region of the outer edge 20 is made of vapor-permeable and preferably perforated material, and so is the last portion of the tongue 18, which is substantially part of the same region of the external edge 20.

As clearly visible in this figure and in the preceding ones, the first element 16*a* covers the external upper 13 except for the regions cited above, therefore comprising the tip of the shoe 10 and also the tongue 18, except, as mentioned, for its last portion.

The insole 15 is instead constituted by a second element 16*b* and can be conveniently covered with a vapor-permeable insole that is interposed between it and the foot. The second element 16*b* is constituted by a second fabric.

The second fabric also is constituted advantageously by a three-dimensional fabric and defines an interspace 17*b* that spaces the foot of the user from the sole 11.

The perimetric coupling of the insole 15 to the inner lining 14 must not prevent ventilation between the interspace 17*a* of the first element 16*a* and the interspace 17*b* of the second element 16*b*, substantially ensuring a free connection between the two, as will become better apparent in another part of the description.

The sole 11 is substantially waterproof and vapor-permeable and comprises a structural layer 21 made of polymeric material that has a series of through holes 22 and with which a waterproof and vapor-permeable functional element 23 is coupled in an upward region, the insole 15 being superimposed thereon.

The functional element 23 preferably has a stratified and cohesive monolithic sheet-like structure, for example of the type disclosed in EP 09425334, by the same Applicant, made of a polymeric material that is impermeable to water in the liquid state and is permeable to water vapor.

Two three-dimensional fabrics, advantageously as a function of the regions of application, are therefore used for the shoe 10.

Figure 4:
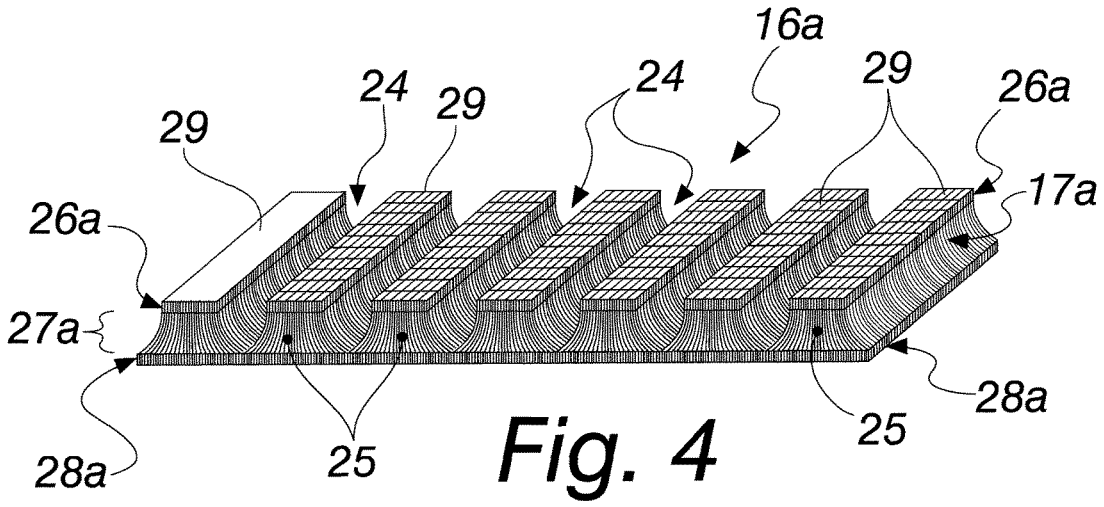
FIG. 4 is an enlarged-scale view of a first element.
Figure 5:
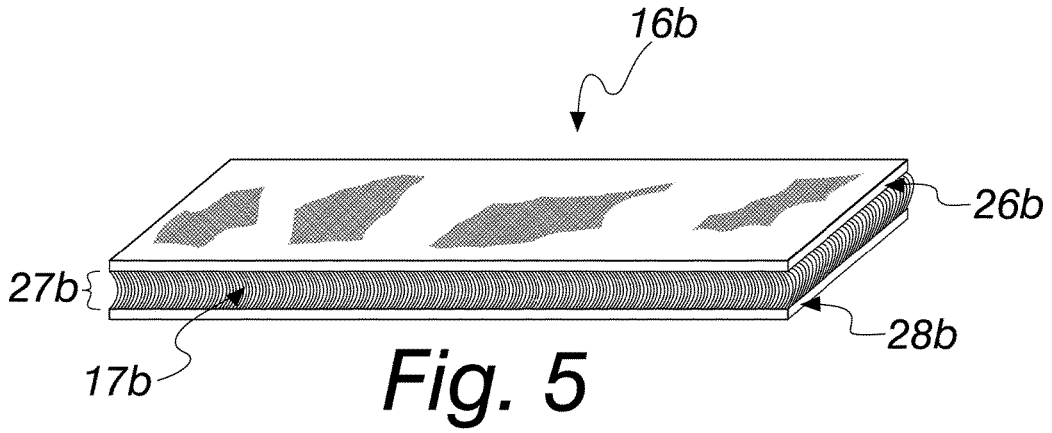
FIG. 5 is an enlarged-scale view of a second element.

FIG. 4 is an enlarged-scale view of the first fabric and FIG. 5 is an enlarged-scale view of the second fabric.

Both fabrics comprise three layers that are mutually joined so as to form a single body.

In particular, the first fabric has the already mentioned preferential passages, which are defined by a series of channels 24, for the passage of sweat in the vapor phase, which are produced by a series of parallel ridges 25.

Figure 2:
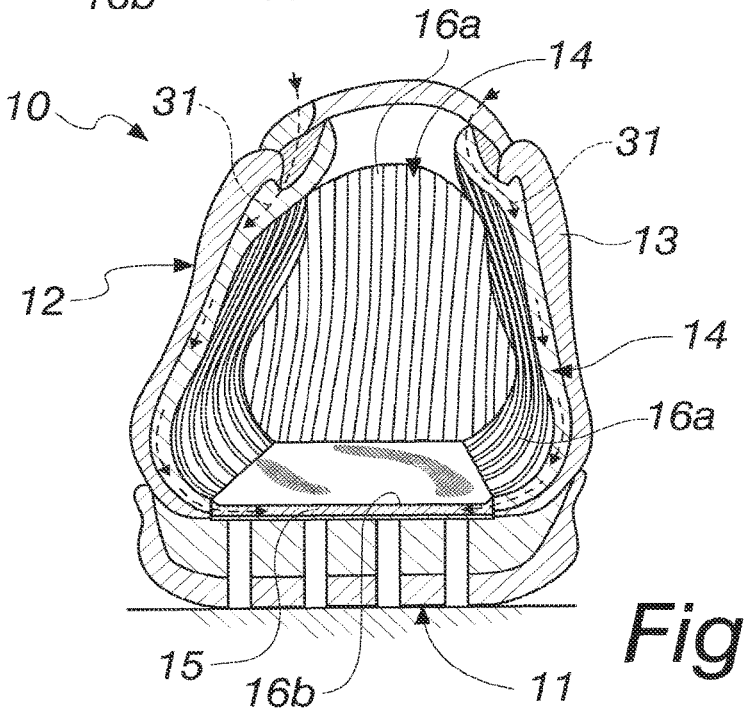
FIG. 2 is a view similar to FIG. 1.

The channels 24, as clearly visible in FIG. 1 and in FIG. 2, are arranged advantageously in the direction of the upper external edge 20 of shoe 10 and are adapted to facilitate the rise of the sweat in the vapor phase upwardly from below. The moist warm air produced by sweating in fact tends to expand naturally due to its own heat and to move always upwardly from below.

The part of inner lining 14 that is constituted by the first element 16*a*, therefore by the first fabric, can be provided by joining a plurality of portions of first fabric, with channels 24 arranged in a different direction depending on the portion of shoe to be lined and as a function of the type of shoe (low-cut, ankle boots, boots, etc.) though achieving in any case the fact that the channels 24 are always oriented toward the external edge 20 of the shoe 10.

More particularly, the first fabric comprises:

- a first layer 26*a*, which is internal and directed toward the foot of the user, which is breathable and adapted to direct the sweat, in the liquid phase and in the vapor phase, away from the foot of the user of the shoe 10,
- a second layer 27*a*, which is intermediate and spacing, defines the interspace 17*a* and the ridges 25, for the transfer of sweat in the liquid phase and in the vapor phase from the first layer 26*a* toward the external upper 13, the ridges 25 being alternated with the channels 24 for the transfer of sweat in the vapor phase toward the external edge 20,
- a third layer 28*a*, which is external and breathable and substantially similar to the first layer 26*a* and which, with the first layer 26*a*, encloses in a sandwich-like manner the second layer 27*a*, interposing itself between the latter and the external upper 13.

The first internal layer 26*a* is constituted by strips 29 of fabric, each of which is arranged so as to affect a corresponding ridge 25. The first layer 26*a*, and therefore the strips 29 that compose it, as well as the second layer 27*a*, are preferably made of polyester fibers or polypropylene fibers or optionally other equivalent fibers.

In particular, the first layer 26*a* is made of mesh, while the second layer 27*a* is constituted by monofilaments that are interwoven with the first layer 26*a*, in particular with the strips 29, so as to define the ridges 25, and with the third layer 28*a*, which is substantially similar to the first layer 26*a*.

The ridges 25 of the second layer 27*a*, joined to the corresponding strips 29 of the first layer 26*a*, have a thickness of no less than 2 mm and preferably comprised between 3 and 4 mm.

The strips 29 of fabric of the first layer 26*a* are not narrower than 2 mm and not wider than 6 mm and preferably have a width of approximately 3 mm.

At the same time, the channels 24 have an average width, between two successive strips 29, of 2 to 8 mm, with a preferable average width of approximately 3 mm.

The first layer 26*a* can be advantageously napped, having a surface with a velvet-like appearance. The napping treatment consists in raising the fibers of the yarns of fabric, substantially a surface pile on the fabric, in order to give a velvet-like appearance at the surface, making it soft and plush. This characteristic allows to retain a larger quantity of air in the fabric, increasing its thermal insulation properties, and gives it a softness that makes it pleasant to the touch.

Napping can also be performed on the third layer 28*a*, further increasing the thermal insulation properties since the raised surface has a greater extension than the surface of the first layer 26*a*.

In particular, in the case of three-dimensional fabric provided by knitting, which is per se known, it is possible to choose the count of the fibers that compose the stitching yarns and the backing yarns of the first layer 26*a*, so that in the napping treatment only the stitching yarns or only the backing yarns are raised, depending on their count, obtaining a velvet-like surface with different properties and/or composition, which can be physical (for example insulation) or aesthetic (for example a selection of colors or decorations) or a combination of the two.

One possible first fabric variation, not shown, is constituted by a first continuous layer, by a second intermediate spacing layer that forms an interspace with channels, for sweat transfer, and by a third layer, which with the first layer forms two walls of the first element that surround the channels formed by the second layer.

The second fabric is, as in the illustrated case, preferably without channels due to the need to remove sweat in the vapor phase toward the breathable sole 11, in the transverse direction, and toward the first fabric.

The second fabric comprises:

- a first upper and breathable layer 26*b*, which is adapted to direct the sweat, in the liquid phase and in the vapor phase, moving away from the foot of the user of the shoe 10,
- a second intermediate and spacing layer 27*b*, which defines the interspace 17*b*, for transfer of the sweat from the first layer 26*b* toward the sole 11 and toward the interspace 17*a* of the first element 16*a*,
- a third external and breathable layer 28*b*, which together with the first layer 26*b* encloses in a sandwich-like manner the second layer 27*b*, interposing itself between the latter and the sole 11.

The layers are provided in a manner substantially similar to those of the first fabric and made of the same materials.

For both fabrics, the first layer 26*a* and 26*b* and the second layer 27*a* and 27*b* can be advantageously hydrophobic and breathable, in order to allow the hot and humid air and the sweat in the vapor state to circulate respectively within the interspace 17*a* and 17*b*, without remaining trapped and absorbed by the fibers.

Furthermore, again for both fabrics, the third layer 28*a* and 28*b* can be of the same type as the first layer 26*a* and 26*b*, therefore hydrophobic and breathable, or can be advantageously of the breathable and substantially hydrophilic type, containing fibers of at least one material selected among cotton, linen, cellulose, plastic material, or other equivalent fibers, conveniently modified in order to have a hydrophilic characteristic, allowing the hot and humid air and the sweat in the liquid state that arrive from the innermost layers to disperse more rapidly and evaporate respectively toward the external upper 13 and toward the functional element 23 of the sole 11.

As regards the dissipation of sweat in the vapor phase, the interspace 17*a* and even more so the channels 24 allow sweat to move continuously upwardly from below, rising between the filaments of the second layer 27*a* and most of all along the channels 24, conveniently oriented in the direction of the upper external edge 20 of the shoe 10.

The channels 24 in fact provide the preferential passages in which sweat in the vapor phase does not encounter obstacles in its rise.

The use of the first fabric therefore is preferable in the inner lining 14, for the transport of warm air, while the second fabric is preferable in the insole 15, for its resiliency.

As anticipated, the region of the upper external edge 20 is made of breathable and preferably perforated material. In this manner, the sweat carried by the ventilation of the air can exit easily from the channels 24.

The sweat in the vapor phase passes through the first layer 26*a* and, by way of the interspace 17*a* and even more so by way of the channels 24, is facilitated in its rising motion.

The sweat in the liquid phase that is on the inner lining 14 originates either directly from the foot or from the condensation of the sweat in vapor phase, which can occur within the first fabric if the conditions outside the shoe are such, with respect to the temperature and pressure between the foot and the first layer 26*a*, as to cause such state transition.

The sweat in the liquid phase passes through the first layer 26*a*, facilitated by the hydrophobic characteristic of such layer, and in succession through the second layer 27*a*, particularly through the ridges 25, until it reaches the third layer 28*a*, which is external and advantageously hydrophilic.

From the third layer 28*a*, the sweat in the liquid phase can evaporate through the external upper 13 if it is breathable or in any case remains at a distance from the first layer 26*a*, therefore in a position of no contact with the foot of the user.

The sweat that forms at the sole of the foot, both in the liquid phase and in the vapor phase, is again moved away from the foot.

The sweat in the vapor phase passes through the first layer 26*b* and, by way of the interspace 17*b*, is facilitated in its motion toward the sole 11 and toward the interspace 17*a* of the first fabric.

In fact, shoe ventilation is based mainly on the fact that sweat and internal moisture are able to access the interspace and to circulate through the preferential passages of the first fabric that are arranged around the foot, both due to a stack effect, caused by the warm air that rises toward the external edge 20, and due to a "pumping effect" caused by the weight of the foot, which during the stride compresses substantially the interspace 17*b* of the insole 15, propelling the sweat and moisture in the interspace 17*a* of the inner lining 14 so that it can exit from the upper external edge 20.

Substantially, in a first ventilation step, which practically coincides with the rolling phase of the foot, the interspace 17*b* of the second element 16*b* of the insole 15 is compressed by the weight of the user, creating an effect of movement of the air contained in the interspace 17*b* in the direction of the interspace 17*a* of the first element 16*a* of the inner lining 14, which allows its movement and expulsion through the upper external edge 20 of the shoe 10.

Figure 6:
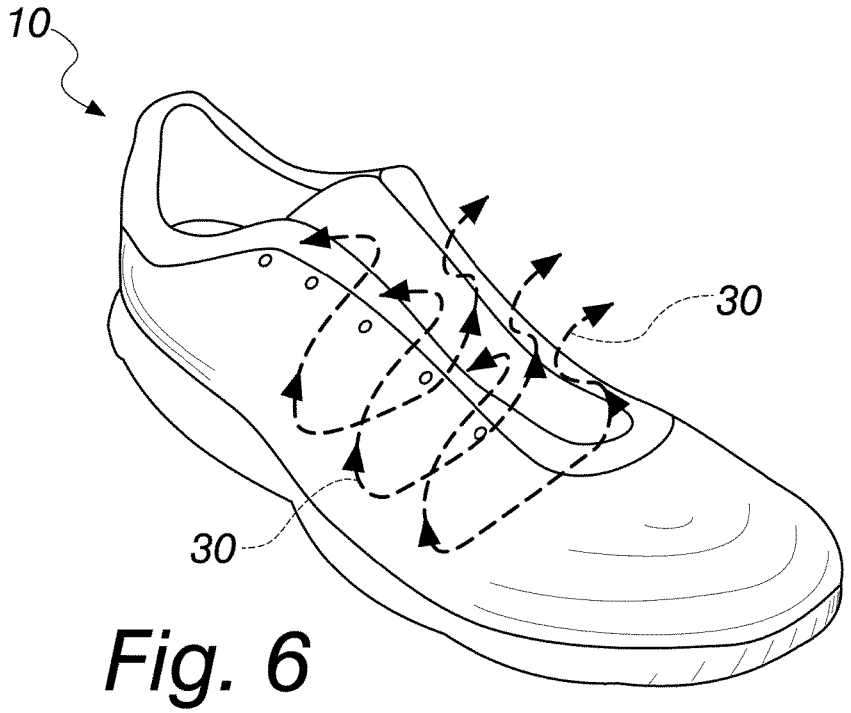
FIG. 6 is a perspective view of the shoe according to the invention.

This first ventilation step is shown in FIG. 1 and in FIG. 6, and the movement of the sweat in the vapor phase is indicated by the arrows with which the reference numeral 30 is associated.

Vice versa, in a second step of ventilation, when the shoe 10 leaves the ground, the interspace 17*b* resumes its initial shape, thanks to the properties of resiliency and shape recovery of the second fabric that constitutes the second element 16*b*, creating a movement of air from the outside through the external edge 20 and the interspace 17*a* of the first element 16*a*.

The movement of the air, in this second step, is designated by the second lines 31 in FIG. 2.

These effects are further promoted by the difference in pressure that is created between the inside and the outside of the shoe due to the movement of the air outside it while walking. The difference in pressure therefore causes the air to circulate more easily in the shoe.

In the described manner, the sweat of the foot can be expelled even if the material of the external upper 13 is not breathable.

As regards instead sweat in the liquid phase, again at the sole of the foot, it passes through the first layer 26*b*, which is preferably hydrophobic and therefore preset to allow the transit of the liquid, and then through the second layer 27*b*. In the interspace 17*b* and on the third layer 28*b*, which is preferably hydrophilic, it tends to pass to the vapor state in order to be dissipated through the waterproof and vapor-permeable functional element 23 of the sole 11.

The use of the first element 16*a* and of the second element 16*b*, constituted by the respective fabrics, therefore allows to provide a ventilated shoe 10 that is capable of ensuring the transport of sweat in the liquid form and/or in the form of vapor from the foot of the user toward the outside of the shoe.

The generated sweat therefore is not retained by the first internal layer, which remains dry, improving the comfort conditions for the user around the entire foot.

The shoe is physiologically more comfortable, allowing the natural temperature adjustment of the foot of the user.

In particular, in geographical areas characterized by particularly rigid climates it is preferable to use a first fabric with a first and or third layer subjected to napping in order to improve thermal insulation in addition to facilitating ventilation.

In practice it has been found that the invention achieves the intended aim and objects by means of a shoe that is capable of better dissipating sweat both in the liquid phase and in the vapor phase than known types of breathable shoe.

The shoe is capable of ensuring ventilation around the foot of the user thanks to the exchange of heat and water vapor between the microclimate inside the shoe and the external microclimate, even if the external material of the upper is not breathable, by way of the dissipation of sweat in vapor form toward the upper external edge of the shoe and through the sole.

The invention thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to requirements and to the state of the art.

The disclosures in Italian Patent Application No. PD2014A000148 from which this application claims priority are incorporated herein by reference.

The invention claimed is:

1. A ventilated shoe, comprising:

a sole; and an upper assembly associated therewith in an upper region, the upper assembly comprising:

an external upper, with which an inner lining is associated which is constituted at least partly by a first element that defines at least one interspace that separates a foot of a user from the external upper and including preferential passages for sweat that moves away from the foot of the user toward an upper external edge of the shoe, a breathable insole, joined perimetrically at least to the inner lining, wherein the preferential passages are defined by a series of channels that facilitate rise of sweat in a vapor phase upwardly from below, and wherein each of the channels is open in a direction of the foot of the user.

2. The shoe according to claim 1, wherein a longitudinal axis of each of the channels extends from the insole to the upper external edge.

3. The shoe according to claim 1, wherein the insole is constituted at least partly by a second element that defines at least one interspace that spaces the foot of the user from the sole.

4. The shoe according to claim 3, wherein the second element is constituted by a second fabric.

5. The shoe according to claim 4, wherein the second fabric comprises:

a first upper and breathable layer, configured to direct the sweat, in liquid phase and in vapor phase, moving away from the foot of the user of the shoe;

a second intermediate and spacing layer, which defines the interspace, for transfer of the sweat from the first layer toward the sole and toward the interspace of the first element;

a third external and breathable layer, which together with the first layer encloses in a sandwich-like manner the second layer, interposing itself between the second layer and the sole;

the first layer, the second layer, and the third layer being joined to form a single body.

6. The shoe according to claim 5, wherein the first upper and breathable layer and the second intermediate and spacing layer are substantially hydrophobic.

7. The shoe according to claim 5, wherein the third external and breathable layer is substantially hydrophobic.

8. The shoe according to claim 5, wherein the third external and breathable layer is substantially hydrophilic.

9. The shoe according to claim 1, wherein the channels are defined by a series of parallel ridges.

10. The shoe according to claim 1, wherein the sole is substantially waterproof and breathable, including a structural layer made of polymeric material including a series of through holes with which a waterproof and breathable functional element is coupled in an upper region, the insole being superimposed on the functional element.

11. The shoe according to claim 10, wherein the functional element has a stratified and cohesive monolithic sheet-like structure made of polymeric material that is impermeable to water in a liquid state and is permeable to water vapor.

12. The shoe according to claim 1, wherein a region of the external edge is made of perforated and breathable material.

13. The shoe according to claim 1, wherein the first element is constituted by a first fabric.

14. The shoe according to claim 9, wherein the first fabric comprises:

a first layer, which is internal and directed toward the foot of the user, which is breathable and adapted to direct the sweat, in liquid phase and in vapor phase, away from the foot of the user of the shoe;

a second layer, which is intermediate and spacing, defines the interspace, and includes the ridges, for the transfer of sweat in the liquid phase and in the vapor phase from the first layer toward the external upper, the ridges being alternated with the channels for transfer of sweat in the vapor phase toward the external edge;

a third layer, which is external and breathable and which, with the first layer, encloses in a sandwich-like manner the second layer, interposing itself between the second layer and the external upper;

the first layer, the second layer, and the third layer being joined to form a single body.

15. The shoe according to claim 14, wherein the first layer and the second layer are substantially hydrophobic.

16. The shoe according to claim 14, wherein the third layer is substantially hydrophobic.

17. The shoe according to claim 14, wherein the third layer is substantially hydrophilic.

18. The shoe according to claim 14, wherein at least one of the first layer and the third layer is napped, having a surface with a velvet-like appearance.

* * * * *